US005651715A

United States Patent [19]

Shedelbower

[11] Patent Number: 5,651,715

[45] Date of Patent: Jul. 29, 1997

[54] GEOMETRIC TOY

[76] Inventor: Randall J. Shedelbower, 1518 Morning Sun Dr., Ballwin, Mo. 63021

[21] Appl. No.: 647,587

[22] Filed: May 13, 1996

[51] Int. Cl.[6] ..... A63H 33/26

[52] U.S. Cl. ..... 446/137; 446/487; 446/488; 446/490; 273/155

[58] Field of Search ..... 446/129, 132, 446/137, 486, 487, 488, 490; 273/155, 157 R

[56] References Cited

U.S. PATENT DOCUMENTS

| | | | |
|---|---|---|---|
| 153,599 | 7/1874 | Owen | 273/157 |
| 232,140 | 9/1880 | Mason | 273/157 |
| 510,216 | 12/1893 | Waibel | 273/155 |
| 847,545 | 3/1907 | Braine | 273/155 |
| 895,114 | 8/1908 | Scrutchin | 273/157 |
| 956,632 | 5/1910 | Finch | 446/119 |
| 994,227 | 6/1911 | Whitelaw | 273/157 |
| 1,236,234 | 8/1917 | Troje | 446/92 |
| 2,327,875 | 8/1943 | Edborg | 273/155 |
| 2,795,893 | 6/1957 | Vayo . | |
| 3,201,894 | 8/1965 | Resch | 273/157 |
| 3,222,072 | 12/1965 | Dreyer | 273/157 |
| 3,836,418 | 9/1974 | Montgomery | 446/487 |
| 4,232,473 | 11/1980 | Jenkins | 446/119 |
| 4,517,251 | 5/1985 | Mosely | 446/488 |
| 4,685,681 | 8/1987 | Rubik et al. | 273/155 |
| 4,722,712 | 2/1988 | McKenna | 446/92 |
| 4,997,375 | 3/1991 | Heinz | 446/119 |
| 5,108,100 | 4/1992 | Essebaggers et al. | 273/157 R |

FOREIGN PATENT DOCUMENTS

| | | | |
|---|---|---|---|
| 2074459 | 11/1981 | United Kingdom | 446/488 |

*Primary Examiner*—Sam Rimell
*Assistant Examiner*—Jeffrey D. Carlson
*Attorney, Agent, or Firm*—Grace J. Fishel

[57] ABSTRACT

A hand held geometric toy with a plurality of polygonal sections strung together with elastic loops. The toy has at least one, and preferably at least three, sets of parallel fold axes and is held in folded condition magnetically.

8 Claims, 3 Drawing Sheets

GEOMETRIC TOY

BACKGROUND OF THE INVENTION

1. Field of the Invention

The present invention relates to a hand held geometric toy that is strung together with elastic loops and held in folded condition magnetically.

2. Brief Description of the Prior Art

There is always a need for a new toy, particularly one that has dual possibilities of being a building toy and a puzzle. Ideally, the puzzle should be simple enough for a child to solve some aspects of it, yet with enough advanced possibilities that it is challenging for an adult. Rubik's Cube® is an example of a toy that fills most of these requirements except that it is not a building toy. The patterns on the faces can be changed but the cube cannot be transformed into other shapes. In addition, Rubik's Cube is passe and there is a continuing need for unexplored toys.

SUMMARY OF THE INVENTION

In view of the above, it is an object of the present invention to provide a toy that is hand held and geometric like Rubik's Cube but can be transformed into other shapes. It is another object to provide a toy that can be folded into a myriad of forms, largely limited only by the imagination of the player. It is also an object to provide a toy that can be played by one person or by many in competition. Other objects and features of the invention will be in part apparent and in part pointed out hereinafter.

In accordance with the invention, a geometric toy is constructed from a plurality of polygonal sections (e.g., isosceles or equilateral triangular cross-sections). Each of the sections has a plurality of vertices and a pair of substantially parallel faces interconnected by side edge faces. Each of the sections also has a magnet between the parallel faces with the poles of the magnet generally perpendicular to the parallel faces.

Neighboring vertices of neighboring sections are elastically interconnected and arranged in an array wherein adjacent sections have opposite magnetic polarity and the side edge faces of adjacent sections are substantially parallel. In addition, the array has at least one set, and preferably at least three sets, of substantially parallel fold axes along the parallel side edge faces about which a portion of the array may be rotated and superimposed on another portion of the array. The superimposed sections are held together by magnetic attraction.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
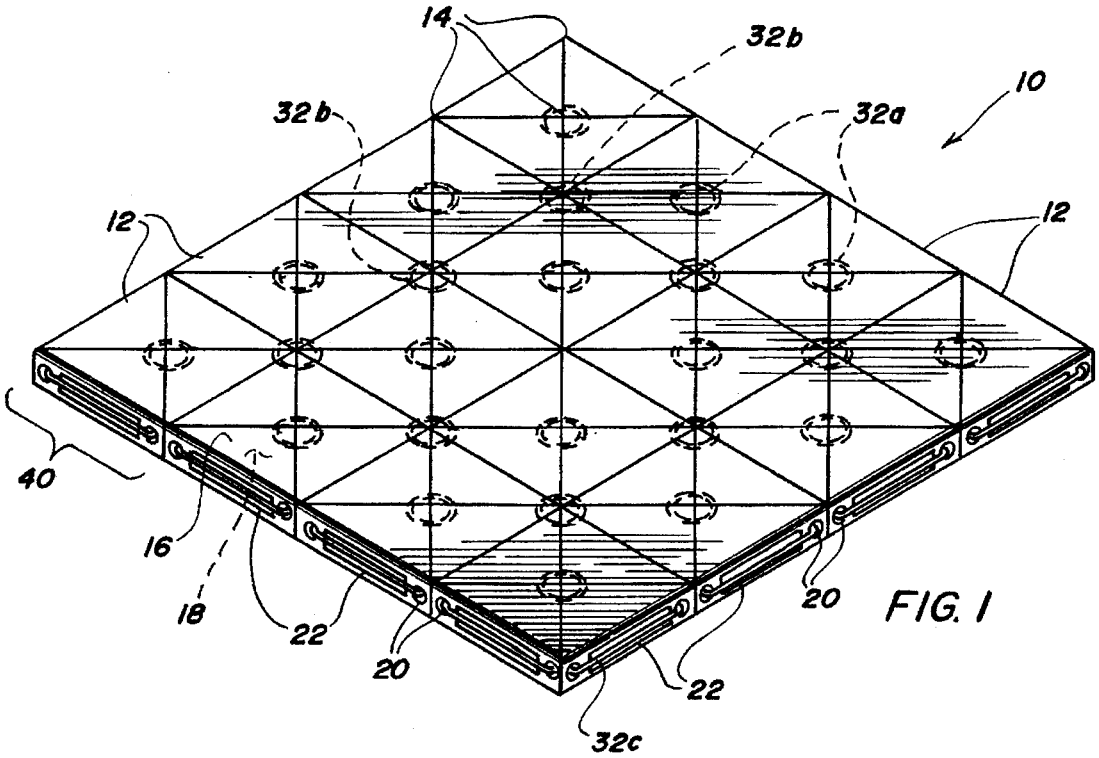
FIG. 1 a perspective view of a geometric toy in accordance with the present invention.
Figure 8:
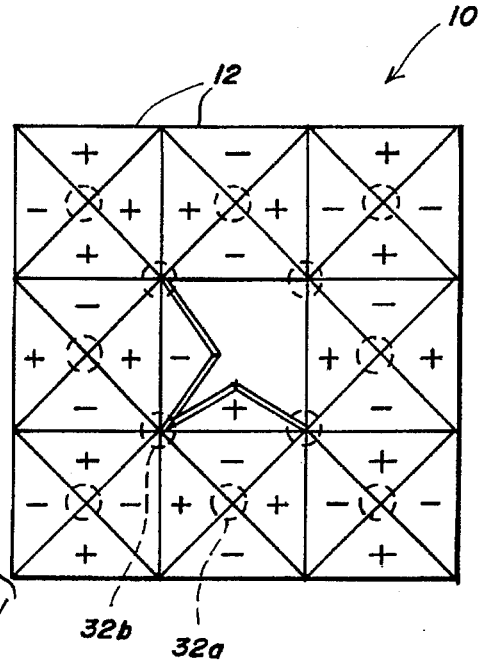
FIG. 8 is a plan view of a second toy in accordance with the present invention.
Figure 9:
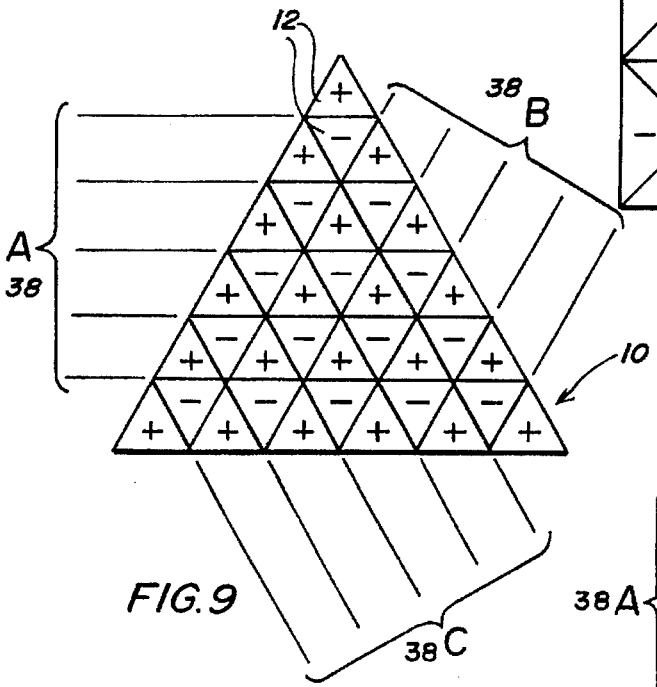
FIG. 9 is a plan view of a third toy in accordance with the present invention with three sets of fold axes indicated; and, FIG. 10 is a plan view of a fourth toy in accordance with the invention with three sets of fold axes marked.
Figure 10:
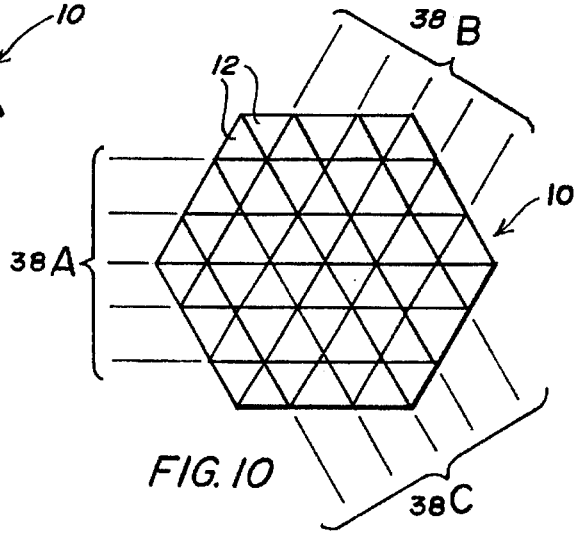

Referring to the drawings more particularly by reference character and with particular reference to FIG. 1, numeral 10 refers to a geometric toy in accordance with the present invention. As shown, toy 10 is formed from a plurality of polygonal sections 12, each of which has a plurality of vertices 14 and a pair of substantially parallel faces 16, 18 interconnected by side edge faces 20. In the form shown in FIG. 1, a variation of which is shown in FIG. 8, sections 12 are same-sized triangular, more particularly right triangular sections, with two equal side edge faces. Sections 12 may take other geometric forms, representative, but non-limiting, ones of which are shown in FIGS. 9 and 10 wherein sections 12 are triangular cross-sections with three equal side edge faces (i.e., isosceles sections).

Figure 5:
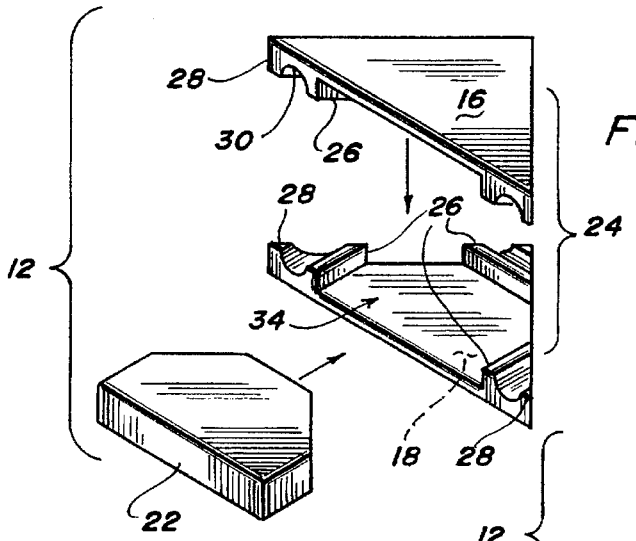
FIG. 5 is a perspective exploded view of a section, from which the toy is constructed.
Figure 6:
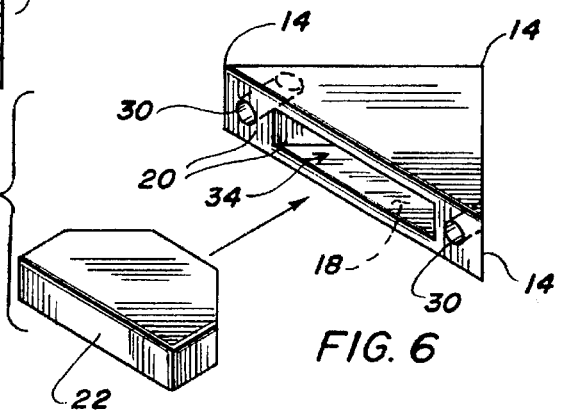
FIG. 6 is a perspective view of a unitary section, from which the toy can be constructed.

Each (i.e., substantially all but not necessarily every) of sections 12 has a magnet 22 positioned between parallel faces 16, 18 with the poles of the magnet generally perpendicular to the parallel faces. Magnet 22 may be formed as a bar or, preferably, as a button. As shown in FIG. 5, parallel faces 16, 18 are part of a two-piece case 24, the pieces of which are of identical shape for ease of fabrication. With continuing reference to FIG. 5, each piece is a triangular plate, the exterior sides of which forms parallel faces 16, 18. On the other side of which (i.e., an interior side) three short ribs 26 are located proximate the three vertices. Three wedges 28 having a height equal to the height of the ribs are located at each vertex on the interior side, said ribs and wedges spaced apart a distance large enough to form an opening 30 adjacent each vertex through which an elastic loop 32 can be passed when the pieces of case 24 are joined. The space between ribs 26 forms a pocket 34 into which magnet 22 of cross-section adapted to fit between the parallel faces can be slipped and preferably glued, bonded or the like for safety considerations, among other reasons. As shown in FIG. 6, case 24 may be of unitary construction with openings 30 and pocket 34 molded in.

Sections 12 are arranged in an array 36 wherein adjacent sections have opposite polarity (see FIGS. 7 and 8–9) and side edge faces 20 of adjacent sections are in substantially parallel planes. The sections are also arranged so that the array has at least one set of substantially parallel fold axes 38 along the parallel side edge faces about which a portion of the array may be rotated and superimposed on another portion of the array. In this folded condition, the superimposed sections and the underlying sections are held together by magnetic attraction. The sections may be arranged in an area-filling array with no voids (as shown) or in an array with one or more of the sections omitted, as an included variant on what is disclosed herein.

Figure 4:
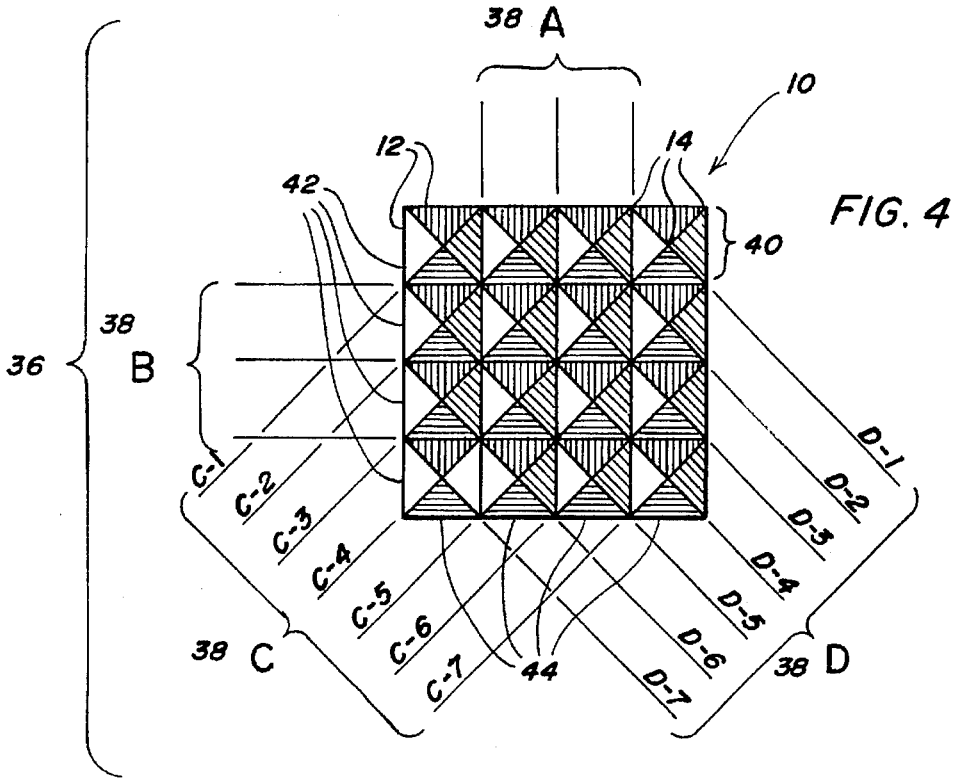
FIG. 4 is a plan view of the toy, lined for color, showing four sets of parallel fold axes.
Figure 7:
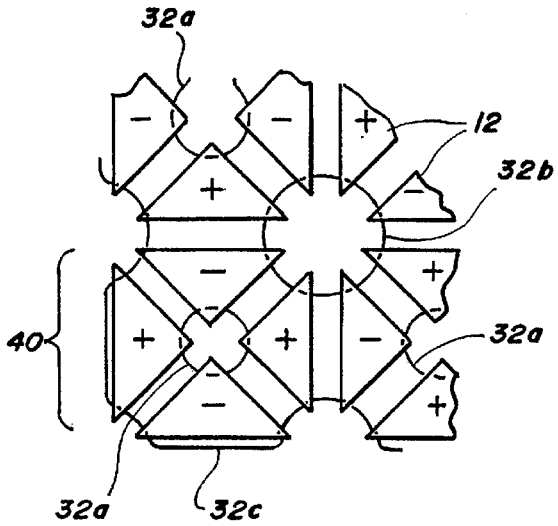
FIG. 7 is a fragmentary, expanded view of a corner of the toy on an enlarged scale.

In array 36 shown in FIG. 4, sections 12 are grouped in blocks 40, four sections to a block, with the blocks arranged in four rows 42 and four columns 44. As seen in FIG. 7, taken in combination with FIG. 1, sections 12 are elastically interconnected at adjoining vertices 14 with elastic loops 32 (i.e., 32*a*, 32*b* and 32*c*) though openings 30 in side edge faces 20 of neighboring sections. Elastic loops 32*a*, 32*b*, and 32*c* are of three lengths, the shortest loop 32*a* joining the right angle vertices of the four sections in each block 40 (sixteen such loops are shown in FIG. 1). Longer elastic loops 32*b* are required for joining the eight forty-five degree vertices in the interior of the array with the exception of the centermost grouping (eight loops 32*b* are shown in FIG. 1). The central one of loops 32*b* is omitted, increasing the variety of forms into which toy device 10 can be folded. A much longer loop 32*c* running about the exterior of the array joins the vertices of the exterior sections.

Figure 2:
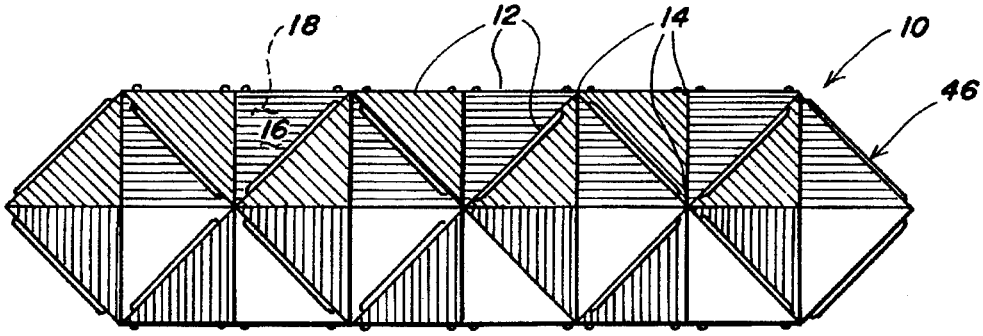
FIG. 2 is a side elevation of the toy, lined for color, folded into an "If" configuration.
Figure 3:
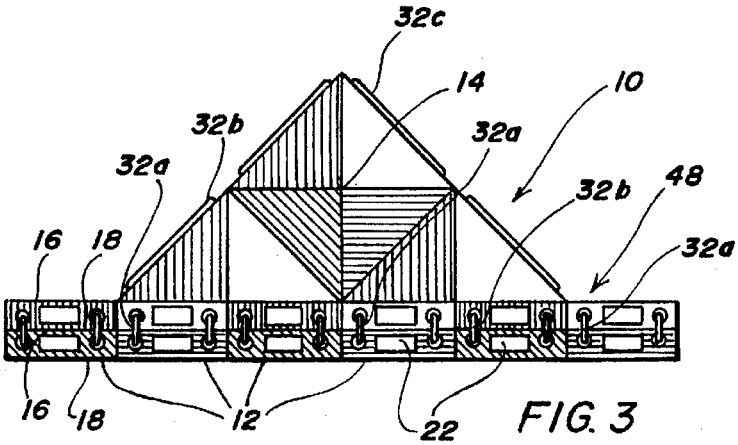
FIG. 3 is a side elevation of the same toy folded into a "sail boat" form.

Array 36 in FIG. 1 has four sets of substantially parallel fold axes as shown in FIG. 4. A first set of axes is labeled "38A", dividing the array into columns 44 and a second set is labeled "38B" dividing the array into rows 42. A third set of diagonal axes are labeled "38C" and a fourth set of diagonal axes are labeled "38D". The individual members of "38C" and "38D" are labeled "C-1" through "C-7" and "D-1" through "D-7", respectively. Using parallel fold axes, toy 10 can be formed into a variety of figures, largely limited only by the imagination of the user. Two illustrative FIGS. 46, 48 are shown in FIGS. 2 and 3, identified by the applicant as an "If" (Imaginary Fantasy—use your "Imagination" to create your "Fantasy") and as a "sailboat", respectively. In the "If" figure, the sections are arranged to form two rows of alternating color (e.g., blue and white alternating across the top and green and red on the bottom). It will be understood that these figures are illustrative only and not limiting.

The "If" shown in FIG. 2 can be constructed by folding the portion of array 36 above fold axis "C-1" towards the center front and the portion of array 36 below fold axis "C-7" towards the center front. The portion of the array 36 above fold axis "C-2" and below "C-6" (including the superimposed portions created by the above moves) is folded along said axes toward the center back. The final moves are made by folding the portion of array 36 above fold axis "C-3" and below "C-5" (including the superimposed portions created by the previous moves) toward the center front, resulting a form, called "If", one side of which is shown in FIG. 2.

The "sailboat" figure can be constructed by folding the portion of array 36 above fold axis "C-3" towards the center front and then folding the portion of array 36 above fold axis "C-2" towards the upper left corner (as viewed in FIG. 3). Corresponding moves are made with the section below fold axis "C-5" and "C-6". The sections above fold axis "C-2" and below fold axis "C-6" are then pushed together until connected together by magnetic attraction. The section above "D-1" and below "D-7" are then folded towards center front, completing the structure.

A second toy device 10 with isosceles cross-sections 12 is shown in FIG. 8. In this instance, blocks 40 are arranged in three rows 42 and three columns 44. The center one (or more) of loops 32*a* is omitted to increase to increase the number of forms into which the toy device can be folded.

Third and fourth toy devices 10 are shown in FIGS. 9 and 10. Sections 12 in these toys are equilateral triangular cross-sections, held together with loops 32*a* through neighboring sections, one (or more) of which loops may be omitted if desired. A longer loop 32*c* laces the external sections together. Toy devices 10 have three sets of fold axes ("38A", "38B" and "38C" as shown) along parallel side edge faces 20 of adjoining sections 12 and can be folded into a variety of figures.

The material from which sections 12 and elastic loops 32 are constructed may vary widely and many materials are suitable. For example, sections 12 may be formed of plastic, metal, wood, cardboard, fiber or any other construction material that may be easily fabricated and is preferably durable and of low cost. Elastic loops 32 are preferably string-like elements with only a slight amount of stretch to them, so that the player will not pull the toy too far out of shape in folding the array along permissible fold axes. For this purpose, the elastic should normally hold all of the sections together with sufficient play being provided so that portions of the array may be rotated as desired. However, in the final form, the elastic should hold toy device 10 compositely in configured form as shown in FIGS. 2 and 3. Thus, any suitable string-like elastic element having these properties may be used, and many elastic strands are available on the market. It is also preferred to use a strand which is sufficiently strong that it may not be easily broken and thereby prevent any inadvertent breakage of the toy during use.

As shown in FIGS. 2–3, sections 12 (e.g., parallel faces 16, 18) are colored and arranged in a pattern. While not entirely necessary, the use of color is desirable, increasing the play value as illustrated by the "If" figure in FIG. 2. Sections 12 may have their surfaces provided with pictures, in addition to colors, or characters, or other designs, the object being to ornament them, so that different arrangements are possible, depending upon the figure into which the toy is folded. The play value can be further enhanced by using multiple geometric toys 10, increasing both the building and puzzle forming possibilities.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A geometric toy comprising a plurality of polygonal sections, each of said sections having a plurality of vertices and a pair of substantially parallel faces interconnected by side edge faces, each of said sections having a magnet between said parallel faces with the poles of the magnet generally perpendicular to said parallel faces, neighboring vertices of said sections are elastically interconnected and arranged in an array wherein adjacent sections have opposite poles and the side edge faces of adjacent sections are parallel, said array having at least one set of substantially parallel fold axes along the parallel side edge faces about which a portion of the array may be rotated and superimposed on another portion of the array, said superimposed sections held together by magnetic attraction.

2. A geometric toy device comprising a plurality of same-sized triangular sections, each of said sections having a plurality of vertices and a pair of substantially parallel faces interconnected by side edge faces, each of said sections having openings extending through the side edge faces proximate the vertices, neighboring vertices of said sections are elastically interconnected with elastic loops passing though the openings in the side edge faces, each of said sections having a magnet between said parallel faces with the poles of the magnet generally perpendicular to said parallel faces, said sections arranged in an area-filling array wherein adjacent sections have opposite poles and the side edge faces of adjacent sections are parallel, said array having at least three sets of fold axes along said parallel side edge faces about which a portion of the array may be rotated and congruently superimposed on another portion of the array, said congruently superimposed portions held together by magnetic attraction.

3. The toy device of claim 2 wherein there are no voids in the array.

4. The toy device of claim 3 wherein each section has at least two equal sides.

5. The toy device of claim 3 wherein each section has three equal sides.

6. The toy device of claim 3 wherein the sections are four different colors and wherein the sections are arranged in a regular pattern in the array.

7. The toy device of claim 3 wherein each section has two equal sides and the sections are arranged in blocks of four and the blocks are arranged into at least three rows and three columns.

8. The toy device of claim 7 wherein a first set of elastic loops joins neighboring vertices of sections in the blocks, a second set of elastic loops joins neighboring vertices of sections not in the blocks in an interior of the array and a third elastic loop joins neighboring vertices of sections about an exterior of the array.

* * * * *